US009310726B2

(12) United States Patent
Ono

(10) Patent No.: US 9,310,726 B2
(45) Date of Patent: Apr. 12, 2016

(54) IMAGE FORMING APPARATUS

(71) Applicant: KYOCERA Document Solutions Inc., Osaka (JP)

(72) Inventor: Tomohisa Ono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/727,713

(22) Filed: Jun. 1, 2015

(65) Prior Publication Data

US 2015/0362875 A1 Dec. 17, 2015

(30) Foreign Application Priority Data

Jun. 12, 2014 (JP) ..... 2014-121763

(51) Int. Cl.

| | |
|---|---|
| ***G03G 15/00*** | (2006.01) |
| ***G03G 15/20*** | (2006.01) |
| ***B65H 5/06*** | (2006.01) |
| ***B65H 7/20*** | (2006.01) |
| ***B65H 9/00*** | (2006.01) |

(52) U.S. Cl.

CPC ..... *G03G 15/2028* (2013.01); *B65H 5/068* (2013.01); *B65H 7/20* (2013.01); *B65H 9/00* (2013.01); *G03G 15/6576* (2013.01)

(58) Field of Classification Search

CPC ..... G03G 15/2021; G03G 15/2028; G03G 15/2032

See application file for complete search history.

(56) References Cited

U.S. PATENT DOCUMENTS

| | | | | |
|---|---|---|---|---|
| 2005/0023742 | A1* | 2/2005 | Tamura | B42B 2/00 270/58.08 |
| 2007/0098470 | A1* | 5/2007 | Shida | G03G 15/6573 399/341 |
| 2007/0212126 | A1* | 9/2007 | Seto | G03G 15/167 399/302 |
| 2010/0247196 | A1 | 9/2010 | Ichiki et al. | |
| 2012/0107029 | A1 | 5/2012 | Moon et al. | |
| 2012/0243910 | A1* | 9/2012 | Aratachi | G03G 15/0806 399/236 |

FOREIGN PATENT DOCUMENTS

| | | | |
|---|---|---|---|
| JP | H09-114153 | A | 5/1997 |
| JP | H09-281827 | A | 10/1997 |

OTHER PUBLICATIONS

The extended European search report issued by the European Patent Office on Oct. 23, 2015, which corresponds to European Patent Application No. 15169156.5-1560 and is related to U.S. Appl. No. 14/727,713.

* cited by examiner

*Primary Examiner* — Walter L Lindsay, Jr.
*Assistant Examiner* — Jessica A Eley
(74) *Attorney, Agent, or Firm* — Studebaker & Brackett PC

(57) ABSTRACT

An image forming apparatus includes a fixing part, a first conveying part, a second conveying part, a biasing member and a separation supporting mechanism. The first conveying part following the fixing part includes rollers to convey a sheet at second linear velocity faster than first linear velocity of the fixing part. The second conveying part following the first conveying part conveys the sheet at third linear velocity faster than the first linear velocity near a heating rotation body of the fixing part from a first reference line passing through nip parts of the fixing part and first conveying part. The separation supporting mechanism supports one roller in a direction separating from another roller and receives force from the sheet in the separating direction to the one roller when the second conveying part conveys the sheet to withdraw the one roller in the separating direction from the first reference line.

5 Claims, 9 Drawing Sheets

IMAGE FORMING APPARATUS

INCORPORATION BY REFERENCE

This application is based on and claims the benefit of priority from Japanese Patent application No. 2014-121763 filed on Jun. 12, 2014, the entire contents of which are incorporated herein by reference.

BACKGROUND

The present disclosure relates to an image forming apparatus preventing a curl from occurring in a sheet conveyed through a fixing part, a first conveying part and a second conveying part.

An image forming apparatus, such as a printer, a copying machine and a facsimile device, heats and melts a toner of a toner image formed on a sheet, such as a printing paper, and fixes an image onto the sheet by further heating. To the sheet, an upward curl or a downward curl may be applied by various factors, such as a load caused in transferring the toner image, a load caused in fixing and a load caused in conveying. Particularly, infixing, because the sheet is heated and moreover pressured, the curl easily occurs in the sheet. The curl occurs remarkably in an end part at an upstream side and an end part at a downstream side in a conveying direction of the sheet. This curl causes a jam due to conveying failure, a stacking failure of the sheet after ejection and others to occur. Therefore, conventionally, it is proposed to restrain the curl occurring in the sheet. For example, the image forming apparatus restraining the curl by quickening conveyance of the sheet after fixing to warp the sheet to an opposite direction to a curl direction in a curved shape is proposed.

However, in a conventional mechanism, because the warp of the sheet passed through a fixing part is not stabilized, dispersion of a contact time of a sheet surface with a heating roller occurs, and then, it is feared that a fixing property of the image onto the sheet is not stabilized. In addition, as a result of the dispersion of the contact time, it is feared that dispersion of glossiness in the conveying direction occurs in the image of the sheet and the image cannot be taken uniformly.

SUMMARY

In accordance with an embodiment of the present disclosure, an image forming apparatus includes a fixing part, a first conveying part, a second conveying part, a biasing member and a separation supporting mechanism. The fixing part includes a heating rotation body arranged at one side of a sheet conveying path and a pressuring rotation body arranged at another side of the sheet conveying path to come into pressure contact with the heating rotation body. The fixing part is rotated at predetermined first linear velocity to sandwich and convey a sheet. The first conveying part is arranged at a downstream side in a conveying direction of the sheet from the fixing part. The first conveying part includes a pair of rollers arranged so as to face to each other across the sheet conveying path and to come into pressure contact with each other. The first conveying part is rotated at second linear velocity faster than the first linear velocity to sandwich and convey the sheet. The second conveying part is arranged at the downstream side in the conveying direction from the first conveying part and arranged at a side of the heating rotation body from a first reference line passing through a nip part of the fixing part and a nip part of the first conveying part. The second conveying part conveys the sheet at third linear velocity faster than the first linear velocity. The biasing member biases one roller to another roller in the pair of rollers. The separation supporting mechanism configured so as to support the one roller biased by the biasing member movably in a separating direction separating from the other roller and so as to receive force in the separating direction applied from the sheet to the one roller when the second conveying part conveys the sheet to withdraw the one roller in the separating direction from the first reference line.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference the drawings, an embodiment of the present disclosure will be described. Incidentally, the following embodiment is an example concreted the disclosure, but does not restrict a technical range of the disclosure. In the following description, upward and downward directions 6 are defined on the basis of a situation where an image forming apparatus 10 according to the embodiment of the disclosure is located on a flat supporting face (a situation shown in FIG. 1). Forward and backward directions 7 are defined so that a front side of the image forming apparatus 10 is positioned at a left side of FIG. 1. Left and right directions 8 (a vertical direction to FIG. 1) are defined on the basis of a direction viewing the image forming apparatus 10 from a front side of FIG. 1. Therefore, in a depth of FIG. 1, a near side is a right side of the image forming apparatus 10 and a far side is a left side.

Figure 1:
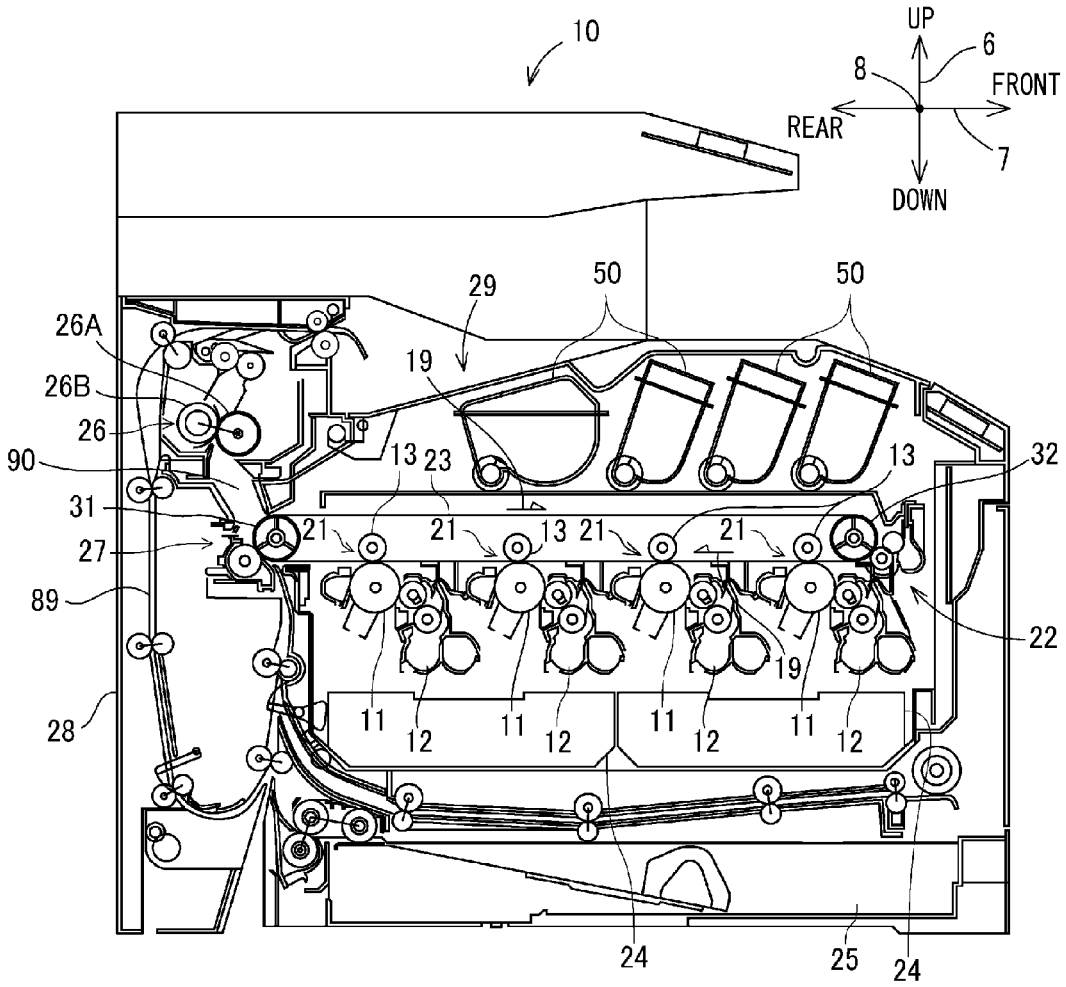
FIG. 1 is a sectional view showing a structure of an image forming apparatus in accordance with an embodiment of the present disclosure.

The image forming apparatus 10 is a device including at least a printing function. As shown in FIG. 1, the image forming apparatus 10 is a color printer of a so-called tandem type. The image forming apparatus 10 prints an image onto a sheet like printing paper (a sheet) by using a developer containing a toner. Incidentally, the image forming apparatus 10 may include at least the printing function, and therefore, may be another image forming apparatus, for example, such as a multifunction peripheral a plurality of functions containing the printing function, or facsimile device or a copying machine. Needless to say, the apparatus may form a color image or form a single color image.

As shown in FIG. 1, the image forming apparatus 10 includes mainly four image forming parts 21, an intermediate transferring unit 22, a sheet feeding device 25, a fixing device 26 (an example of a fixing part), a pair of conveying rollers 35 (an example of a first conveying part), a pair of ejecting rollers 37 (an example of a second conveying part), a second transferring device 27, an exposing device 24 and four toner container 50 (50A-50D). These components are attached to an apparatus main body 28 as a housing composing an outer frame (not shown) and an inner frame (not shown) of the image forming apparatus 10.

The four image forming parts 21 are arranged below the intermediate transferring unit 22 inside the apparatus main body 28. The image forming parts 21 are arranged in parallel along the forward and backward directions 7. Each image forming part 21 executes image forming process forming an image onto the printing paper under a so-called electro-photographic manner. Concretely, each image forming part 21 prints the image onto the printing paper on the basis of image data inputted from the outside via a network communicating part (not shown). Each image forming part 21 includes a photosensitive drum 11, a charging device (not shown), a developing device 12, a first transferring device 13 and others. The image forming parts 21 form toner images onto the respective photosensitive drums 11 and superimpose in sequence and transfer the toner images onto a transferring belt 23 provided in the intermediate transferring unit 22. The transferring belt 23 is moved in a direction indicated by an arrow 19 and the toner images are transferred in sequence on the transferring belt 23 in moving. An example shown in FIG. 1, in order from a downstream side in a moving direction (the arrow 19's direction) of the transferring belt 23 inside the apparatus main body 28, the image forming parts 21 corresponding to black, cyan, magenta and yellow are arranged in a line.

The intermediate transferring unit 22 is arranged above the image forming parts 21. The intermediate transferring unit 22 is supported so as to be bridged between a driving pulley 31 and a following pulley 32. Thereby, a belt surface is extended in the forward and backward directions 8 in a flat state. The transferring belt 23 is moved (run) in the arrow 19's direction while its surface comes into contact with a surface of each photosensitive drum 11.

The second transferring device 27 transfers the toner image, which is composed of a plurality of colors and transferred onto the transferring belt 23, onto the printing paper. The printing paper with the transferred toner image is conveyed by passing thorough a sheet conveying path 90 from the second transferring device 27 to an ejected sheet tray 29. Along the sheet conveying path 90, the fixing device 26, the pair of conveying rollers 35 and the pair of ejecting rollers 37 are arranged in order.

The printing paper having the toner image transferred by the second transferring device 27 is conveyed to the fixing device 26 thorough the sheet conveying path 90. The fixing device 26 fixes the toner image, which is transferred onto the printing paper, onto the printing paper by heat and pressure. The fixing device 26 has a heating roller 26A (an example of a heating rotation body) heated at high temperature and a pressuring roller 26B (an example of a pressuring rotation body) arranged to face to the heating roller 26A. The heating roller 26A and the pressuring roller 26B come into pressure contact with each other, and then, sandwich and convey the printing paper by predetermined pressure contact force at a nip part 26C as a pressure contact part between the respective rollers. At that time, to the toner image, the heat is applied and the pressure is applied, and then, the toner image is welded to the printing paper. In the embodiment, the pressure contact force of the nip part 26C in fixing operation is sufficiently larger than biasing force of a coil spring 64 mentioned later, that is, larger than pressure contact force of a nip part 35C of the pair of conveying rollers 35 mentioned later.

When a distal end of the printing paper conveyed upwardly from the fixing device 26 reaches the pair of conveying rollers 35, the printing paper is sandwiched by the pair of conveying rollers 35 and further conveyed to the downstream side in a conveying direction. The printing paper further conveyed to the downstream side by the pair of conveying rollers 35 is sandwiched and conveyed by the pair of ejecting rollers 37. Thereby, the printing paper is ejected onto the ejected sheet tray 29 arranged in an upper part of the apparatus main body 28.

In the following, with reference to FIGS. 2-4, structures of the sheet conveying path 90, the fixing device 26, the pair of conveying rollers 35 and the pair of ejecting rollers 37 will be described in detail.

The sheet conveying path 90 is arranged at the rear side in the apparatus main body 28, in detail, arranged in a path extended upwardly from the second transferring device 27 along a back face wall of the apparatus main body 28, and then, curved to a forward side to reach the ejected sheet tray 29. As shown in FIG. 2, the sheet conveying path 90 is made by a plurality of guide members 91-99 appropriately arranged along the sheet conveying path 90. That is, the sheet conveying path 90 is demarcated by the guide members 91-99. Incidentally, in FIG. 2, the sheet conveying path 90 is indicated by a broken line, but the sheet conveying path 90 is a space with a given width demarcated by the guide members 91-99 in actual fact.

In the sheet conveying path 90, a conveying path 90A from the second transferring device 27 to the fixing device 26 is made by the guide members 91 and 92 arranged so as to face to each other. The guide members 91 and 92 are extended diagonal upwardly from the second transferring device 27 to a slight back side. According to this, the printing paper conveyed through the conveying path 90A from the second transferring device 27 is guided upwardly in a state inclined diagonal backwardly to a vertical direction. In the vicinity of an upper end part of the conveying path 90A, the guide member 93 guiding the distal end of the printing paper to the nip part 26C of the fixing device 26 is arranged. The guide member 93 is arranged at the rear side in the apparatus main body 28 from the conveying path 90A as a boundary. The guide member 93 plays a role as a deflection guide deflecting the distal end of the printing paper to the nip part 26C. The distal end of the printing paper reached the guide member 93 is directed to the nip part 26C by the guide member 93, thereby the distal end of the printing paper is smoothly sandwiched by the fixing device 26.

The fixing device 26 has the heating roller 26A and the pressuring roller 26B as mentioned above and those come into pressure contact with each other to form the nip part 26C.

On the assumption that the sheet conveying path 90 is as a reference, the heating roller 26A is arranged at one side of the sheet conveying path 90, concretely at an inner side of the apparatus main body 28 from the sheet conveying path 90. The pressuring roller 26B is arranged at another side of the sheet conveying path 90, concretely at the rear side in the apparatus main body 28 from the sheet conveying path 90. That is, in FIG. 1, the heating roller 26A is arranged at a right side from the sheet conveying path 90 and the pressuring roller 26B is arranged at a left side from the sheet conveying path 90.

The heating roller 26A is formed in a cylindrical shape and, inside it, a heating device 60, such as a heater, is arranged. The heating roller 26A is heated at predetermined temperature from the inside by the heating device 60. The heating roller 26A is made of a high heat conductivity material, such as metal.

The pressuring roller 26B is made of a softer material than the heating roller 26A, for example, made of urethane rubber, silicone rubber or the like. The pressuring roller 26B is biased to the heating roller 26A by an elastic member (not shown), such as a spring. Thereby, the pressuring roller 26B and the heating roller 26A come into pressure contact with each other and, in its pressure contact area, the nip part 26C is formed. As mentioned above, since the pressuring roller 26B is made of the soft material, as shown in FIG. 2, the pressuring roller 26B is dented in an inward arc shape when coming into pressure contact with the heating roller 26A. That is, the nip part 26C takes a form dent in an arc shape to a side of the pressuring roller 26B.

Moreover, it is configured so that, when fixing operation by the fixing device 26 is carried out, the pressuring roller 26B is driven and rotated and the heating roller 26A is co-rotated with the pressuring roller 26B by contact friction with the pressuring roller 26B. As a driving system, for example, a configuration transmitting rotation driving force from a motor as a drive source via a drive transmitting mechanism, such as a gear, to the pressuring roller 26B can be applied. In the embodiment, the pressuring roller 26B is driven and rotated so that circumferential speed (linear velocity) of its external circumference becomes predetermined circumferential speed V1 (first linear velocity). According to this, the printing paper with the distal end reached the fixing device 26 is conveyed to a downstream side at the circumferential speed V1 by the fixing device 26.

Figure 4:
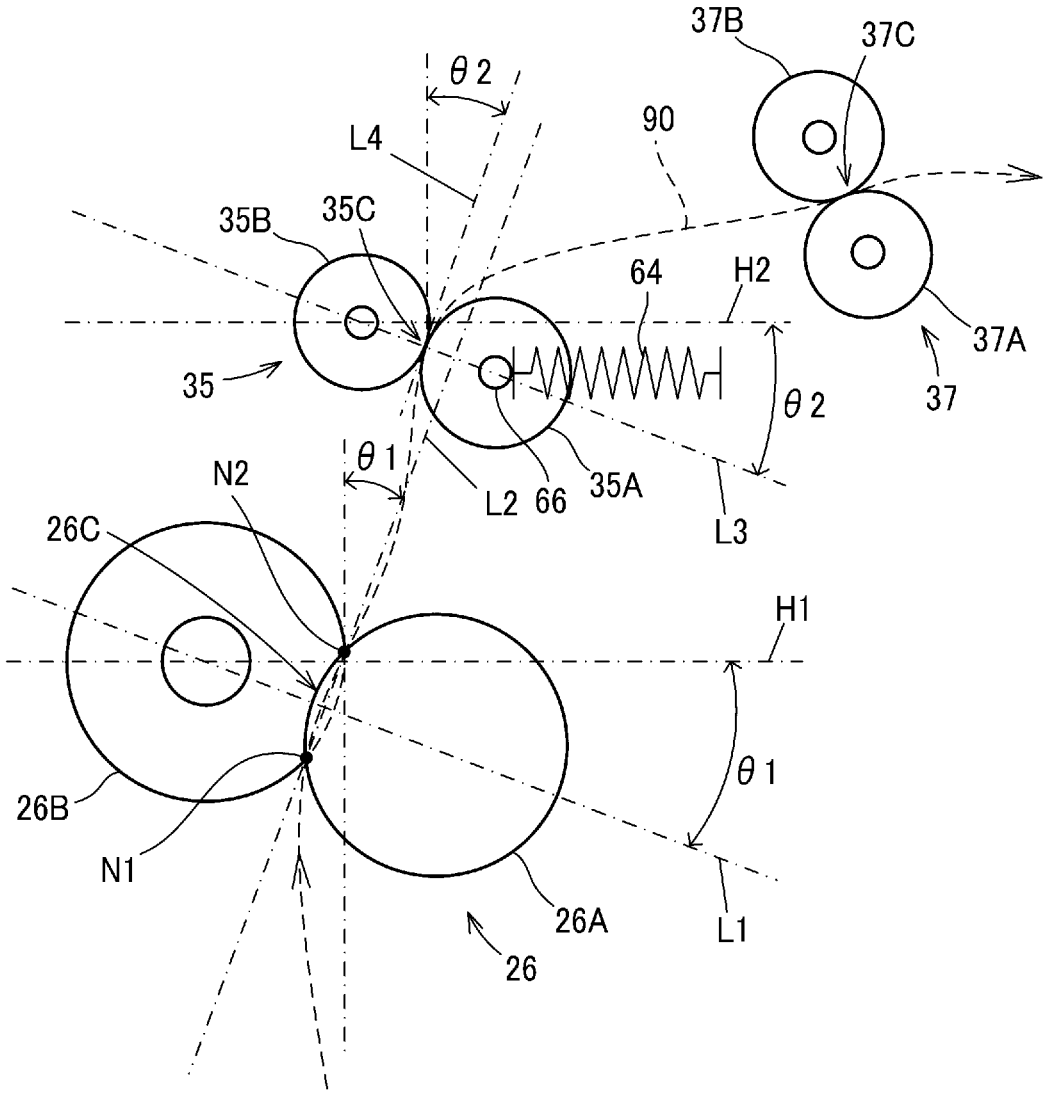
FIG. 4 is a schematic sectional view showing the fixing part, the ejecting roller and their periphery.

As shown in FIG. 4, in the fixing device 26, the heating roller 26A is arranged below the pressuring roller 26B. Concretely, the heating roller 26A is arranged at a position where a straight line L1 passing through a center of the heating roller 26A and a center of the pressuring roller 26B intersects a horizontal line H1 passing through the center of the pressuring roller 26B at an angle θ1. According to this, a straight line L2 (an example of a second reference line) passing through both end parts N1 and N2 of the nip part 26C in the conveying direction of the printing paper is inclined at the angle θ1 to the vertical direction.

Figure 2:
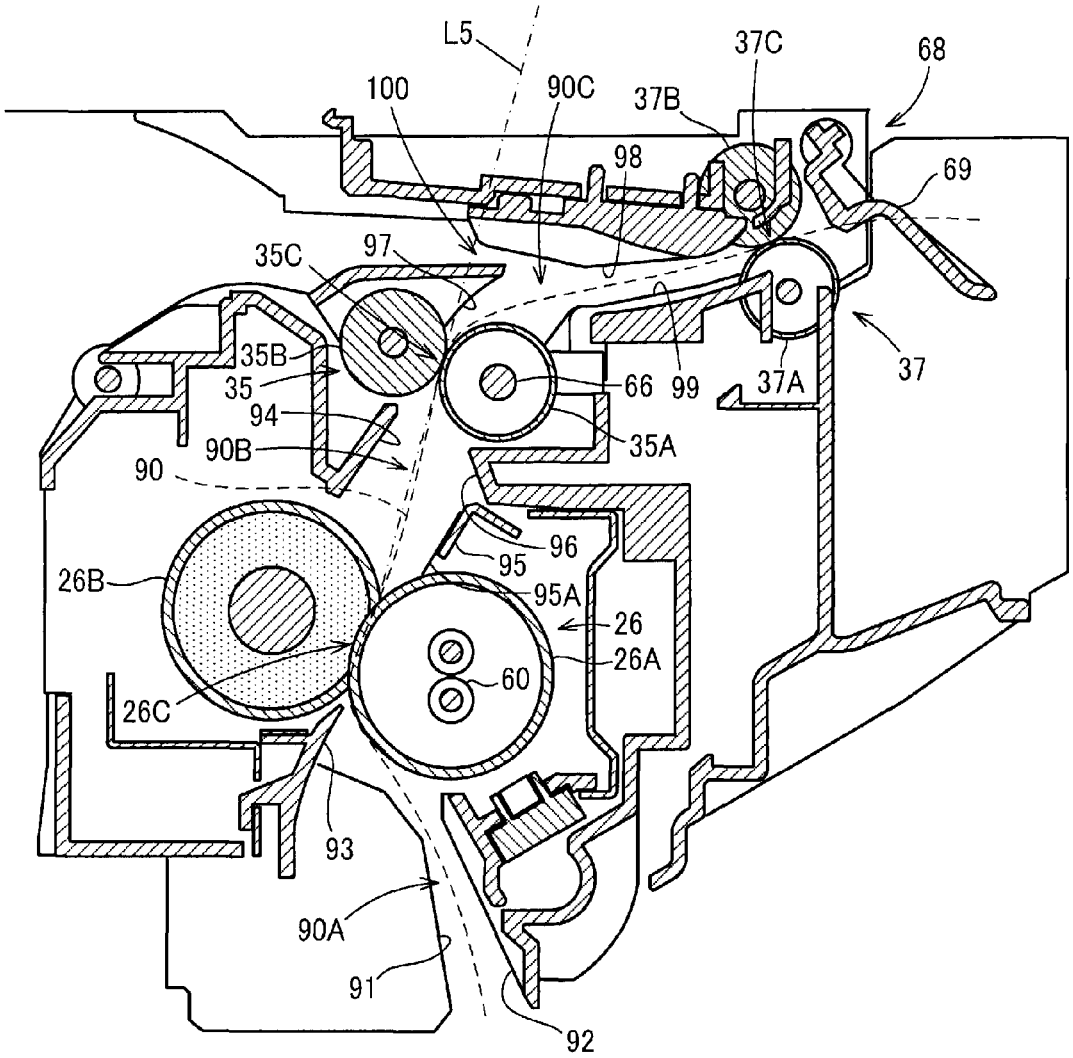
FIG. 2 is an enlarged view showing a fixing part, an ejecting roller and their periphery of the image forming apparatus shown in FIG. 1.

As shown in FIG. 2, the pair of conveying rollers 35 are arranged at forwardly diagonal upward side from the fixing device 26. That is, the pair of conveying rollers 35 are arranged at the downward side in the conveying direction of the printing paper from the fixing device 26. In the sheet conveying path 90, a conveying path 90B from the fixing device 26 to the pair of conveying rollers 35 is made by the guide member 94 arranged at aback side in the apparatus main body 28 and the guide members 95 and 96 arranged so as to face to the guide member 94. The guide member 95 is arranged at a side of the fixing device 26 and the guide member 96 is arranged at a side of the pair of conveying rollers 35. To the guide member 95, a claw formed separation blade 95A is attached. The separation blade 95A separates the printing paper stuck onto the heating roller 26A and its distal end is extended to the vicinity of a roller face of the heating roller 26A. The distal end of the separation blade 95A may come into contact with a surface of the heating roller 26A or may be in non-contact state at a distance of a slight gap. By these guide members 94, 95 and 96, the printing paper is guided upwardly through the conveying path 90B. In the embodiment, as mentioned later, the conveying path 90B is not extended upwardly in the vertical direction, but inclined slightly forwardly.

The pair of conveying rollers 35 have a pair of rollers arranged so as to face to each other across the sheet conveying path 90 and to come into pressure contact with each other. Concretely, the pair of conveying rollers 35 are composed of a following roller 35A (one roller) and a driving roller 35B (another roller). The following roller 35A and the driving roller 35B come into pressure contact with each other to form the nip part 35C (a roller pressure contact part). On the assumption that the sheet conveying path 90 is as a reference, the following roller 35A is arranged at the one side of the sheet conveying path 90, concretely at the inner side of the apparatus main body 28 from the sheet conveying path 90. The driving roller 35B is arranged at the other side of the sheet conveying path 90, concretely at the rear side in the apparatus main body 28 from the sheet conveying path 90. That is, in FIG. 1, the following roller 35A is arranged at the right side from the sheet conveying path 90 and the driving roller 35B is arranged at the left side from the sheet conveying path 90.

Figure 3:
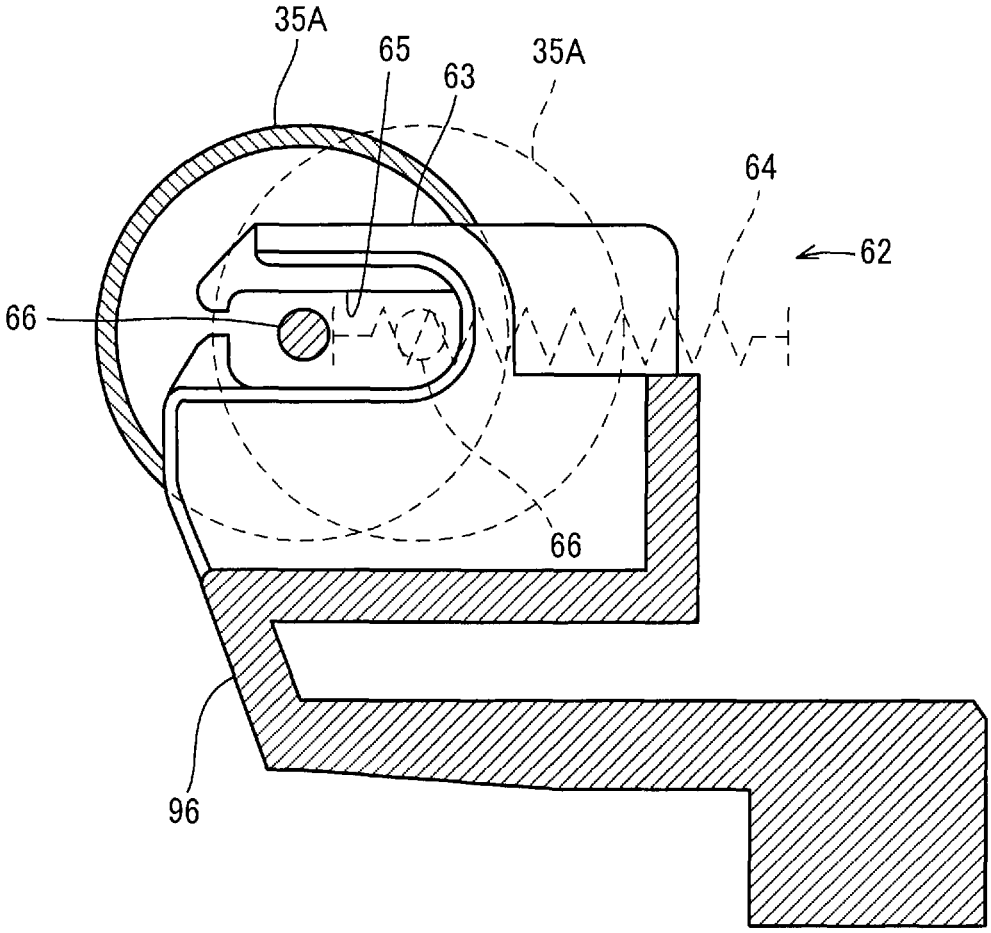
FIG. 3 is a sectional view showing a separation supporting mechanism of a following roller.

As shown in FIG. 3, the following roller 35A is biased to the driving roller 35B. Concretely, the following roller 35A is biased to a side of the driving roller 35B by a coil spring 64 (a biasing member) included in a supporting mechanism 62 (a separation supporting mechanism). Thereby, between the driving roller 35B and the following roller 35A, the nip part 35C is formed.

The supporting mechanism 62 is arranged at the inner side of the apparatus main body 28 from the sheet conveying path 90. The supporting mechanism 62 has a supporting part 63 made integrally with the guide member 96 and the coil spring 64 as an elastic member. The supporting part 63 has guide grooves 65 arranged at both ends in a width direction of the sheet conveying path 90 and, by the guide grooves 65, a rotation shaft 66 of the following roller 35A is supported. The coil spring 64 has one end connected to the rotation shaft 66 and another end connected a frame (not shown), thereby elastically biasing the following roller 35A to the side of the driving roller 35B. Incidentally, elastic biasing force of the coil spring 64 is sufficiently smaller than the pressure contact force between the heating roller 26A and the pressuring roller 26B in the fixing device 26. In the embodiment, a configuration including the coil spring 64 in the supporting mechanism 62 is illustrated, but the coil spring 64 may be provided as a separate member from the supporting mechanism 62.

By transmitting the rotation driving force from the drive source (not shown) to the driving roller 35B, the driving roller 35B is driven and rotated. The following roller 35A is configured so as to co-rotate with the driving roller 35B by contact friction with the driving roller 35B. In the embodiment, the driving roller 35B is driven and rotated so that circumferential speed (linear velocity) of its external circumference becomes predetermined circumferential speed V2 (second linear velocity). The circumferential speed V2 is faster than the circumferential speed V1. According to this, in a case where the pair of conveying rollers 35 singly conveys the printing paper, it is possible to convey the printing paper at a faster speed than a conveying speed of the fixing device 26. However, as described above, the elastic biasing force of the coil spring 64 is sufficiently smaller than the pressure contact force of the fixing force of the fixing device 26. Therefore, in a case where the printing paper is sandwiched by both the fixing device 26 and the pair of conveying rollers 35, the printing paper is conveyed at the circumferential speed V1 by the fixing device 26 with hardly being affected by conveying force of the pair of conveying rollers 35.

As shown in FIG. 4, in the embodiment, the pair of conveying rollers 35 are arranged at the back side in the apparatus main body 28 from the straight line L2. Concretely, in a condition where the pair of conveying rollers 35 form the nip part 35C, the driving roller 35B and the following roller 35A are arranged so that the nip part 35C is formed at the back side from the straight line L2. In addition, the following roller 35A is arranged below the driving roller 35B. Concretely, the following roller 35A is arranged at a position where a straight line L3 passing through a center of the following roller 35A and a center of the driving roller 35B intersects a horizontal line H2 passing through the center of the driving roller 35B at an angle θ2. According to this, a straight line L4 passing through the nip part 35C and being perpendicular to the straight line L3 is inclined at the angle θ2 to the vertical direction. Incidentally, the angle θ2 is determined by factors, such as a position of the pair of ejecting rollers 37 and the elastic biasing force of the coil spring 64. In the embodiment, the angle θ2 is set, as an example, to a slight smaller angle than the angle θ1.

As shown in FIG. 2, the pair of ejecting rollers 37 are arranged at a front side in the apparatus main body 28 from the pair of conveying rollers 35. The pair of ejecting rollers 37 are arranged at a downstream side in the conveying direction in the sheet conveying path 90 curved from the pair of conveying rollers 35. In the embodiment, the pair of ejecting rollers 37 are arranged at a side of the heating roller 26A from a reference line L5 (an example of a first reference line) passing through the nip part 26C of the fixing part 26 and the nip part 35C of the pair of conveying rollers 35, i.e. at the front side in the apparatus main body 28. The reference line L5 is accurately a straight line passing through an end part of the nip part 26C at the downstream side in the conveying direction and an end part of the nip part 35C at the upstream side in the conveying direction.

The pair of ejecting rollers 37 are arranged in the vicinity of an ejecting port 68 in which the printing paper is ejected from the apparatus main body 28. In the ejecting port 68, a flap 69 pressing the ejected printing paper is axially supported. The pair of conveying rollers 35 have a pair of rollers arranged so as to face to each other across the sheet conveying path 90 and to come into pressure contact with each other. Concretely, the pair of ejecting rollers 37 are composed of a following roller 37A and a driving roller 37B. The driving roller 37B and the following roller 37A come into pressure contact with each other to forma nip part 37C. On the assumption that the sheet conveying path 90 is as a reference, the following roller 37A is arranged at the one side of the sheet conveying path 90, concretely at the inner side of the apparatus main body 28 from the sheet conveying path 90. The driving roller 37B is arranged at the other side of the sheet conveying path 90, concretely at an upper side in the apparatus main body 28 from the sheet conveying path 90. That is, in FIG. 1, the following roller 37A is arranged at a lower side from the sheet conveying path 90 and the driving roller 37B is arranged at an upper side from the sheet conveying path 90.

By transmitting the rotation driving force from the drive source (not shown) to the driving roller 37B, the driving roller 37B is driven and rotated. The following roller 37A is configured so as to co-rotate with the driving roller 37B by contact friction with the driving roller 37B. In the embodiment, the driving roller 37B is driven and rotated so that circumferential speed (linear velocity) of its external circumference becomes predetermined circumferential speed V3 (third linear velocity). The circumferential speed V3 is faster than the circumferential speed V1.

In the sheet conveying path 90, a conveying path 90C from the pair of conveying rollers 35 to the pair of ejecting rollers 37 is made by the guide members 97 and 98 arranged at the upper side in the apparatus main body 28 and the guide member 99 arranged at the inner side of the apparatus main body 28. The guide member 99 has a guide face gently inclined ascendingly from the pair of conveying rollers 35 to the pair of ejecting rollers 37. The guide member 98 is arranged so as to face to the guide member 99 above the guide member 99. At the upstream side in the conveying direction of the guide member 98 (i.e. at the side of the pair of conveying rollers 35), the guide member 97 is arranged at a distance of a predetermined gap 100. The guide face of the guide member 97 is formed in a curved shape, thereby a direction of the printing paper passed through the pair of conveying rollers 35 is changed to the front side by the guide member 97. Incidentally, at a further back side of the conveying path 90A, an inversion conveying path 89 is arranged. In the image forming apparatus 10, when the printing paper is conveyed in switch back way (inversely conveyed) by the pair of ejecting rollers 37 for duplex printing, the printing paper is guided from the gap 100 to the inversion conveying path 89.

In the image forming apparatus 10 configured thus, in a case where the printing paper passed through the fixing device 26 is sandwiched and conveyed by the pair of ejecting rollers 37, to the following roller 35A, force from the printing paper in a separating direction separating the following roller 35A from the driving roller 35B (refer to arrows D4 in FIGS. 8 and 9) is applied. By receiving the force from the printing paper, the following roller 35A is moved to the separating direction against the biasing force of the coil spring 64. Thereby, the following roller 35A is separated from the driving roller 35B and withdrawn in the separating direction from the reference line L5 (refer to FIG. 2). In the following, with reference to FIGS. 5-9, conveying operation of the printing paper in the sheet conveying path 90 and separating operation of the following roller 35A will be described.

Figure 5:
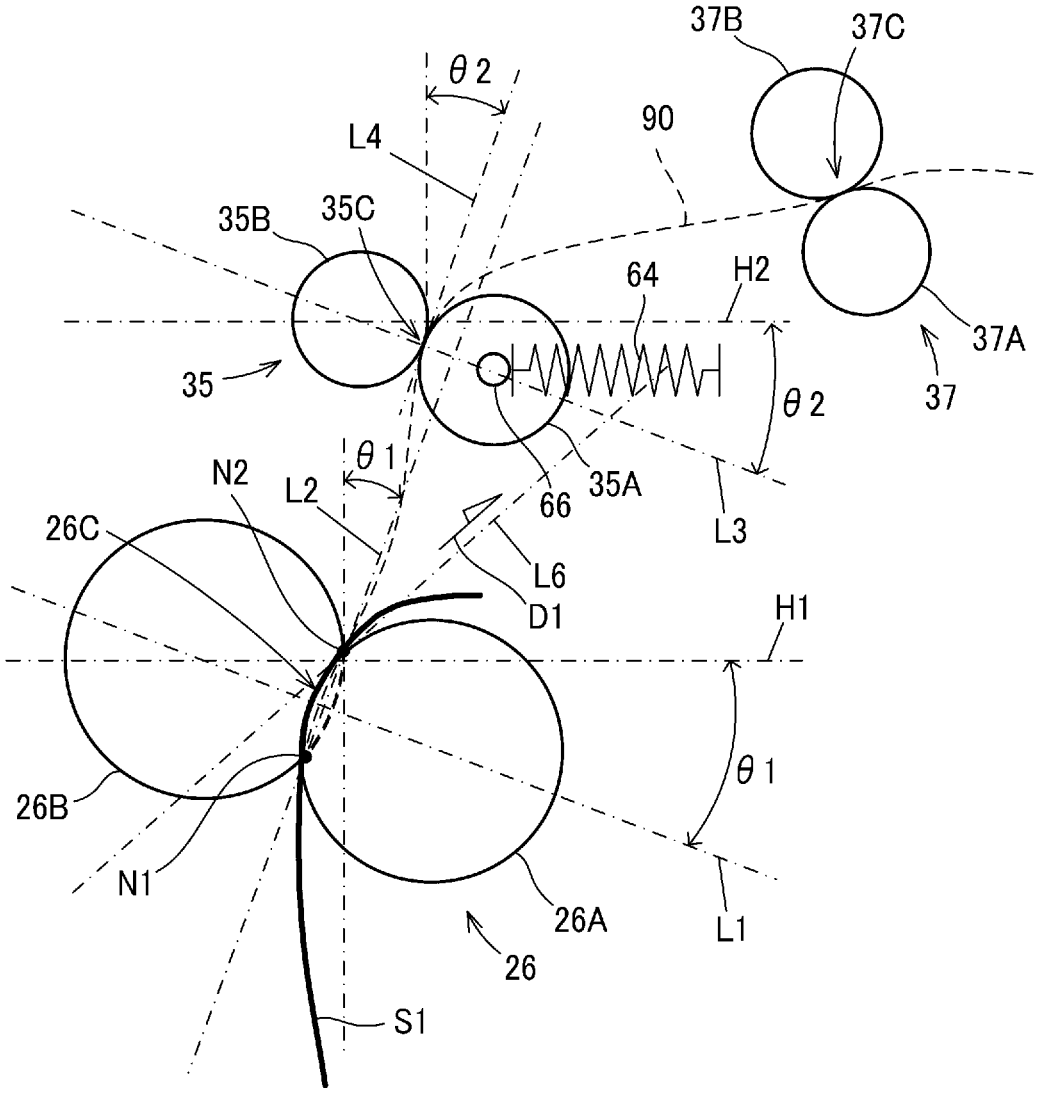
FIG. 5 is a schematic sectional view showing the fixing part, the ejecting roller and their periphery in a sheet conveying state when a sheet is conveyed from the fixing part to the ejecting roller.
Figure 6:
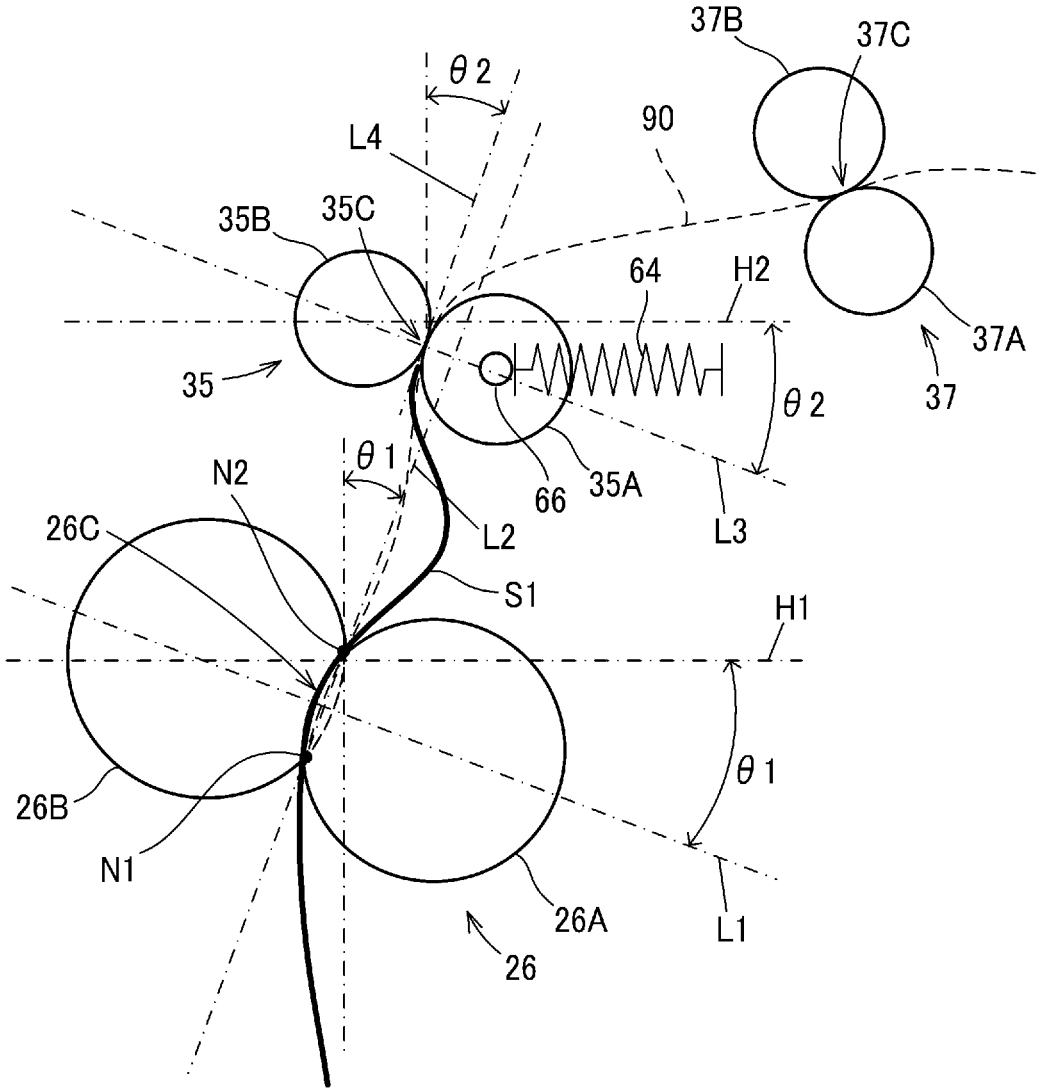
FIG. 6 is a schematic sectional view showing the fixing part, the ejecting roller and their periphery in another sheet conveying state when a sheet is conveyed from the fixing part to the ejecting roller.

As shown in FIG. 5, when the distal end of the printing paper S1 reaches the nip part 26C of the fixing device 26 during fixing operation, the printing paper S1 is sandwiched and conveyed by the fixing device 26. At this time, the printing paper S1 is conveyed while deforming along the nip part 26C in the arc shape. That is, while the printing paper S1 is passing through the nip part 26C, the printing paper S1 is deformed in the arc shape. Thereby, the distal end of the printing paper S1 passed through the nip part 26C is curled in the same direction as the arc shape of the nip part 26C.

In addition, since the nip part 26C has the arc shape dented in the inward of the pressuring roller 26B, the printing paper S1 passed through the end part N2 at the downstream side in the conveying direction is not ejected in a direction of the straight line L2, but is ejected in a direction of a straight line L6 indicated in FIG. 5 (refer to an arrow D1 in FIG. 5). The straight line L6 is a tangential direction of an arc face in the vicinity of the end part N2 in the nip part 26C in the arc shape.

In a state that the distal end is curled, when the printing paper S1 is further ejected to the direction of the straight line L6, the distal end of the printing paper S1 comes into contact with the guide members 95 and 96. At this time, the printing paper S1 receives force in an opposite direction to the curled direction from the guide members 95 and 96. Thereby, the distal end of the printing paper S1 is guided to the nip part 35C of the pair of conveying rollers 35 by the guide members 95 and 96 while deforming in a direction reducing the curl.

Figure 7:
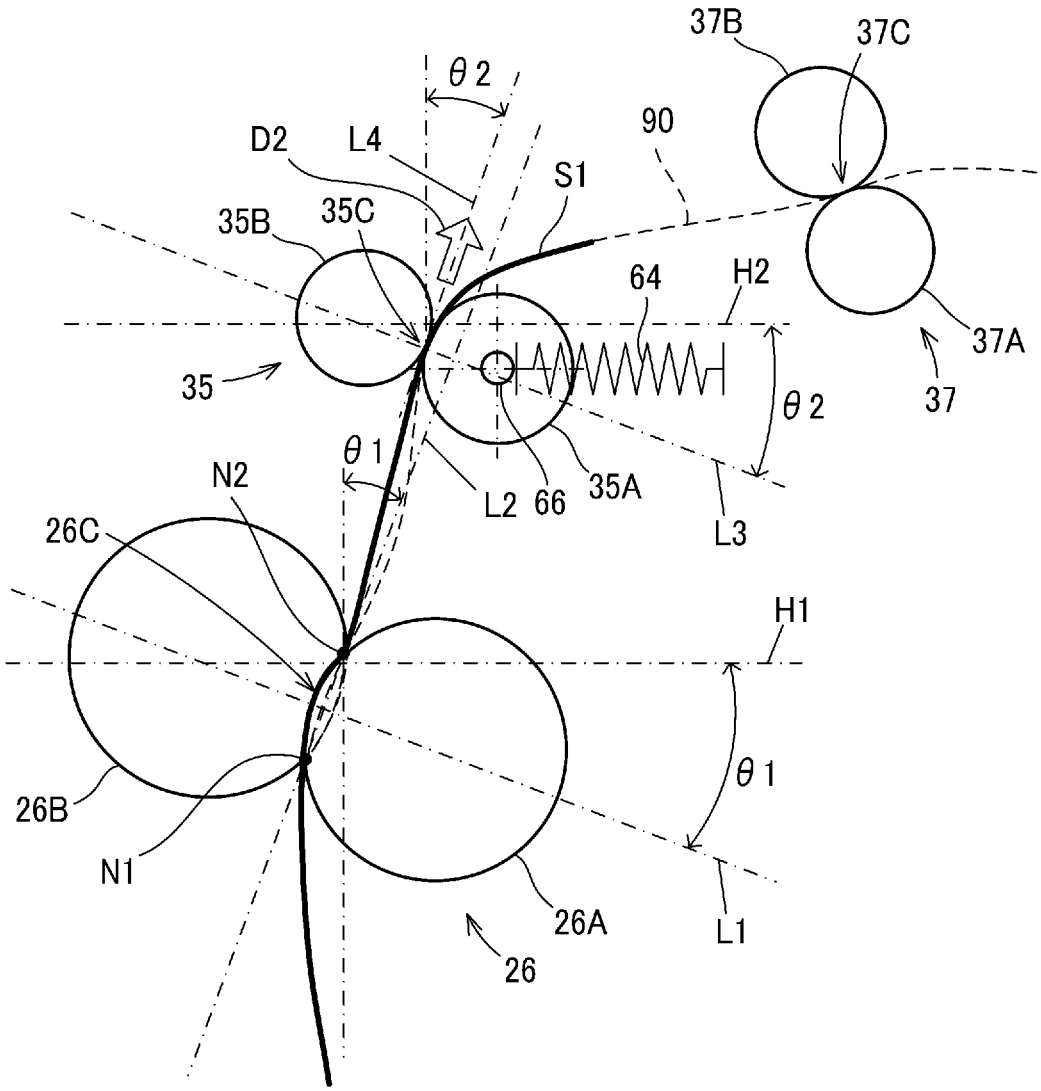
FIG. 7 is a schematic sectional view showing the fixing part, the ejecting roller and their periphery in a different further sheet conveying state when a sheet is conveyed from the fixing part to the ejecting roller.

When the distal end of the printing paper S1 reaches the nip part 35C, the printing paper S1 is sandwiched and conveyed by the nip part 35C. As described above, the circumference speed V2 of the pair of conveying rollers 35 is faster than the circumference speed V1 of the fixing device 26. Therefore, even if the printing paper S1 becomes a warped state in the conveying path 90B, as shown in FIG. 7, the printing paper S1 is pulled to the side of the pair of conveying rollers 35 (refer to an arrow D2) by rotation of the pair of conveying rollers 35 and the warp is solved. Thereby, fixing failure and image failure caused by dispersion of a contact time with the heating roller 26A due to the warp of the printing paper S1 are solved.

Moreover, as described above, the pair of conveying rollers 35 are arranged at the back side in the apparatus main body 28 from the straight line L2. Therefore, when the printing paper S1 is pulled by the pair of conveying rollers 35, the pulling acts on the printing paper S1 tending to stick onto the heating roller 26A in a direction peeling the printing paper S1. This prevents the printing paper S1 from sticking and winding onto the heating roller 26A and prevents curl forming caused by sticking of the printing paper S1 onto the heating roller 26A.

Incidentally, if the pair of conveying rollers 35 are positioned at the back side in the apparatus main body 28 from the straight line L2, the following problem may occurs. That is, if the printing paper S1 is pulled by the pair of conveying rollers 35 as shown in FIG. 7, the printing paper S1 is conveyed while a back face (an image non-formed face) of the printing paper S1 is pressed onto the end part N2 of the nip part 26C. According to this, by the pressing to the end part N2, the printing paper S1 may be curled to the back side in the apparatus main body 28. Particularly, if the curl is formed in an rear end of the printing paper S1, both corners of the rear end of the printing paper S1 may be bent. If the printing paper S1 with remaining the curl is ejected to the ejected sheet tray 29, the following printing paper may be inserted into a lower side of the curl of the rear end of the last printing paper, and then, a stuck state of the printing papers may be disordered and, in some cases, a stacking order of the printing papers may be replaced.

Figure 8:
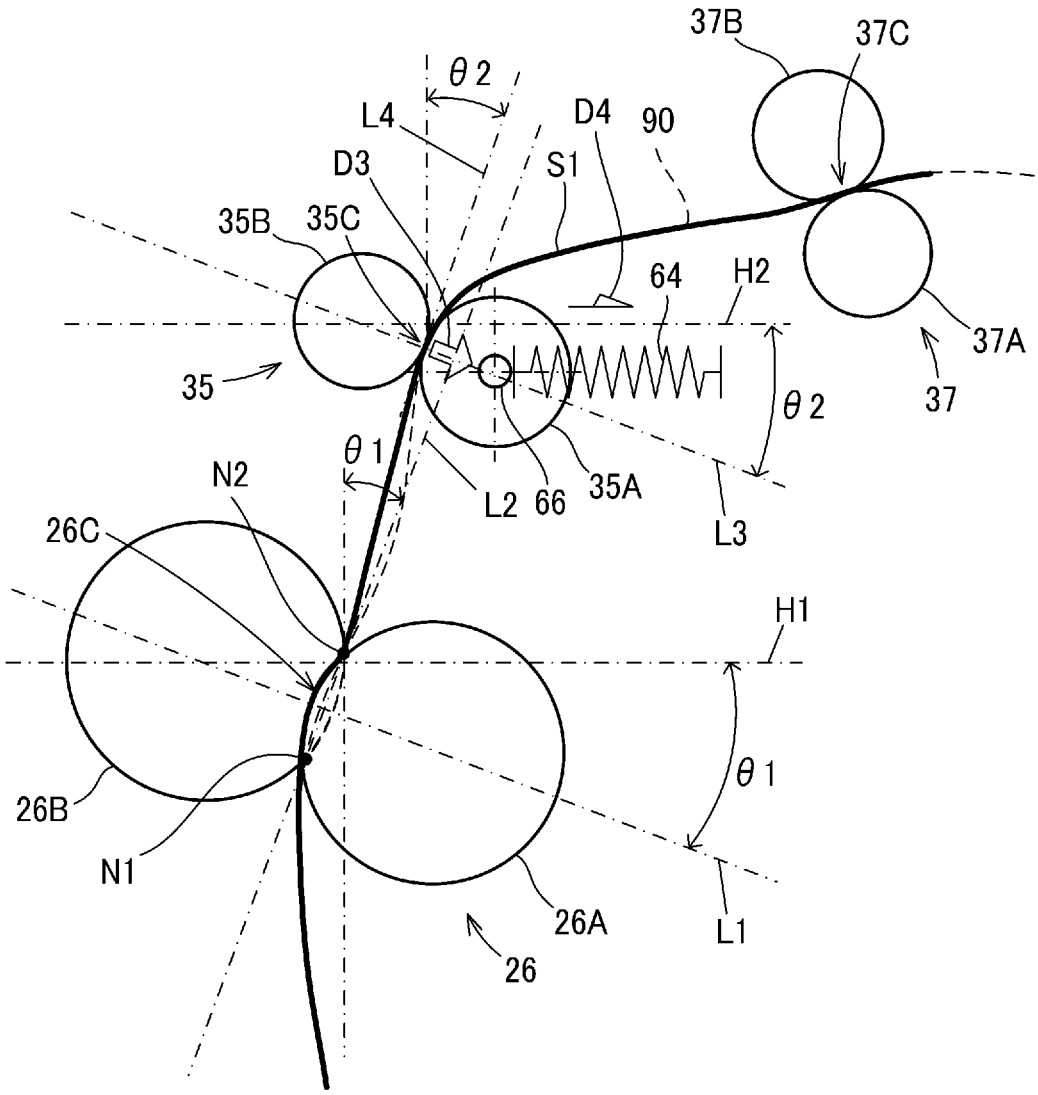
FIG. 8 is a schematic sectional view showing the fixing part, the ejecting roller and their periphery in another different sheet conveying state when a sheet is conveyed from the fixing part to the ejecting roller.

As shown in FIG. 8, when the distal end of the printing paper S1 reaches the nip part 37C of the pair of ejecting rollers 37, the printing paper S1 is sandwiched and conveyed by the nip part 37C. As described above, the circumference speed V3 of the pair of ejecting rollers 37 is faster than the circumference speed V1 of the fixing device 26. According to this, since the printing paper S1 is sandwiched and conveyed by the pair of ejecting rollers 37, the printing paper S1 is pulled to a side of the pair of ejecting rollers 37. At this time, tension in the conveying direction occurs to the printing paper S1 and the tension is applied as force separating the following roller 35A from the driving roller 35B (refer to an arrow D3 in FIG. 8) into the following roller 35A. This force acts on the following roller 35A so as to move the following roller 35A to the front side in the apparatus main body 28 (refer to arrows D4 in FIGS. 8 and 9) against the biasing force of the coil spring 64. Thereby, the following roller 35A is separated from the driving roller 35B and withdrawn in the separating direction indicated by the arrow D4 from the reference line L5 (refer to FIG. 2).

Figure 9:
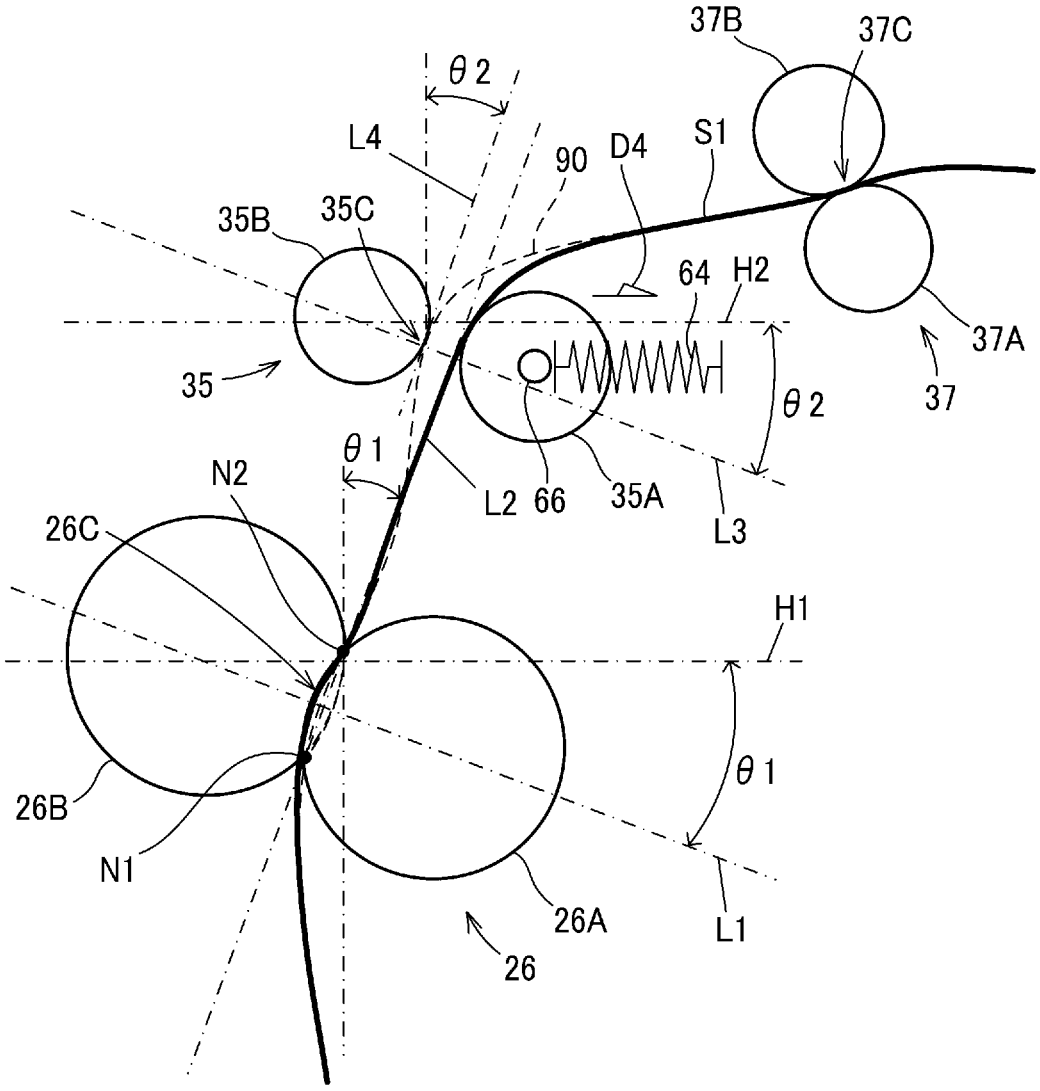
FIG. 9 is a schematic sectional view showing the fixing part, the ejecting roller and their periphery in a further different sheet conveying state when a sheet is conveyed from the fixing part to the ejecting roller.

In the embodiment, as shown in FIG. 9, by receiving the force from the printing paper S1, the supporting mechanism 62 is configured so as to separate (withdraw) the following roller 35A to the straight line L2. Concretely, the following roller 35A is withdrawn in the separating direction until a roller face of the following roller 35A reaches a position of the straight line L2. Thereby, in the conveying path 90B of the sheet conveying path 90, the printing paper S1 is conveyed in a state matching to the straight line L2. In such a case, since the back face (the image non-formed face) of the printing paper S1 does not come into contact with the end part N2 of the nip part 26C, even if the printing paper S1 is pulled by the pair of conveying rollers 35, the printing paper S1 is not pressed to the end part N2. Therefore, the curl to the back side of the printing paper S1 due to pressing to the end part N2 is prevented.

Incidentally, although, in the above-mentioned embodiment, the pressure contact force of the nip part 37C of the pair of ejecting rollers 37 is not mentioned, it may be configured so that the pressure contact force of the nip part 37C is larger than the pressure contact force of the nip part 35C. In such a case, conveyance capacity of the pair of ejecting rollers 37 is increased and it is possible to surely apply the force from the printing paper S1 to the following roller 35A.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus, comprising:

a fixing part including a heating rotation body arranged at one side of a sheet conveying path and a pressuring rotation body arranged at another side of the sheet conveying path to come into pressure contact with the heating rotation body, and being rotated at predetermined first linear velocity to sandwich and convey a sheet;

a first conveying part arranged at a downstream side in a conveying direction of the sheet from the fixing part, and including a pair of rollers arranged so as to face to each other across the sheet conveying path and to come into pressure contact with each other and being rotated at second linear velocity faster than the first linear velocity to sandwich and convey the sheet;

a second conveying part arranged at the downstream side in the conveying direction from the first conveying part and arranged at a side of the heating rotation body from a first reference line passing through a nip part of the fixing part and a nip part of the first conveying part, and conveying the sheet at third linear velocity faster than the first linear velocity;

a biasing member biasing one roller to another roller in the pair of rollers; and a separation supporting mechanism configured so as to support the one roller biased by the biasing member movably in a separating direction separating from the other roller and so as to receive force in the separating direction applied from the sheet to the one roller when the second conveying part conveys the sheet to withdraw the one roller in the separating direction from the first reference line, wherein the pressuring rotation body is made of a softer material than the heating rotation body to form the nip part dented in an inward arc shape when coming into pressure contact with the heating rotation body, the first conveying part is arranged at a side of the pressuring rotation body from a second reference line passing through both end parts of the nip part of the fixing part in the conveying direction, the separation supporting mechanism is configured so as to withdraw at least the one roller to the second reference line.

2. The image forming apparatus according to claim 1, wherein the nip part of the fixing part has pressure contact force larger than pressure contact force of the nip part of the first conveying part.

3. The image forming apparatus according to claim 2, wherein the second conveying part includes a pair of rollers arranged so as to face to each other across the sheet conveying path and to come into pressure contact with each other and a nip part of the second conveying part has pressure contact force larger than the pressure contact force of the nip part of the first conveying part.

4. The image forming apparatus according to claim 1, further comprising:

a guide member arranged at one side of the sheet conveying path to make a conveying path from the fixing part to the first conveying part.

5. The image forming apparatus according to claim 4, wherein the guide member is configured so that a claw formed separation blade is attached.

* * * * *